United States Patent [19]

Terzian

[11] 4,271,497

[45] Jun. 2, 1981

[54] QUADRI-BALANCED DIGITAL TIME DISPLAYS

[76] Inventor: Berj A. Terzian, 330 Madison Ave., New York, N.Y. 10017

[21] Appl. No.: 886,121

[22] Filed: Mar. 13, 1978

Related U.S. Application Data

[63] Continuation-in-part of Ser. No. 861,115, Dec. 16, 1977.

[51] Int. Cl.[3] ..... G04C 19/00; G04C 17/00; G09F 9/00

[52] U.S. Cl. ..... 368/82; 368/239; 340/756

[58] Field of Search ..... 58/4 A, 50 R, 127 R; 368/82–84, 239–242; 340/756

[56] References Cited

U.S. PATENT DOCUMENTS

| | | | |
|---|---|---|---|
| 3,576,099 | 4/1971 | Walton | 58/50 R |
| 3,613,351 | 10/1971 | Walton | 58/50 R |
| 3,701,249 | 10/1972 | Bergey et al. | 58/50 R |
| 3,722,206 | 3/1973 | Bergey | 58/50 R |
| 3,760,582 | 9/1973 | Thiess et al. | 58/50 R |
| 3,760,584 | 9/1973 | Dargent | 58/50 R |

FOREIGN PATENT DOCUMENTS

| | | | |
|---|---|---|---|
| 1388127 | 3/1975 | United Kingdom | 58/50 R |
| 1442630 | 7/1976 | United Kingdom | 58/50 R |
| 1475413 | 6/1977 | United Kingdom | 58/50 R |

OTHER PUBLICATIONS

Die Uhre, Uhren Juwelen und Schmuck, 1977, #8, pp. 34–35.

*Primary Examiner*—Vit W. Misha

*Attorney, Agent, or Firm*—Eyre, Mann, Lucas & Just

[57] ABSTRACT

Quadri-balanced digital time displays for presenting readouts in which (A) during the first quarter of an hour, minute digits are positioned in a relatively upper area trailing hour digits and operated to count minutes from 1 to 15, (B) during the second quarter hour, minute digits are positioned in a relatively lower area trailing hour digits and operated to count minutes from 16 to 30, (C) during the third quarter hour, minute digits are positioned in a relatively lower area leading hour digits and operated to count minutes from 29 to 15, and (D) during the fourth quarter hour, minute digits are positioned in a relatively upper area leading hour digits and operated to count minutes from 14 to 00, with the hour digits having been advanced to the next hour during the third and fourth quarter hours. Such quadri-balanced displays provide immediately comprehendible readouts of time in both gross and precise contexts.

32 Claims, 6 Drawing Figures

OSC.
FREQ. DIVIDER
÷10
÷3
÷2
DECODER DRIVER
÷6
S

QUADRI-BALANCED DIGITAL TIME DISPLAYS

CROSS-REFERENCE TO RELATED APPLICATION

This application is a continuation-in-part of copending application Ser. No. 861,115, filed Dec. 16, 1977.

BACKGROUND OF THE INVENTION

1. Field of the Invention

This invention relates to time keeping and, more particularly, to the use of digital time displays for general purpose time keeping. The term "general purpose", as applied to digital time displays or digital time keeping in context of the ensuing description, is used qualitatively to refer to the general time keeping needs and practices of ordinary individuals occupied with their usual activities on a day-to-day basis, as distinguished from specialized time monitoring procedures used in particular circumstances, e.g., scientific experiments, computer operations, games and sporting events, etc.

2. Description of the Prior Art

General purpose digital time displays have been available to consumers over the past several years in a variety of products, e.g. wrist watches, clocks, clock-radios and numerous other articles. Such displays generally consist of a horizontal array of hour and minute digits separated by a colon, with the hour digits positioned to the left and the minute digits to the right, and with the minute digits being driven to count values up from 01 to 59 and, one minute later, to reset to 00, with a simultaneous increase in the value of the hour digits to that of the next hour. On occasion, with liquid crystal type displays, second digits are also provided, positioned to the right of the minute digits and also driven to count seconds up from 01 to 59, with resetting to 00 one second later, when the value of the minute digits is increased to the next minute. In other instances, such as with light emitting diode type displays, switching is employed to display second digits alone, counted as described above but without a simultaneous display of hour and minute digits.

Although such displays and products have been commercially successful, they have not displaced completely, or even to a major extent, their analog counterparts and competition. The latter are based upon the conventional twelve-hour dial face with hour, minute, and optionally second, hands rotating through 360° to indicate the time by the progressive positions of the hands relative to spaced markings applied along the dial perimeter. Many consumers, both prospective and actual, have found currently available general purpose digital time displays to be inconvenient, awkward difficult to use or otherwise objectionable in comparison to analog time displays, and often because of poorly perceived or definable reasons.

Although it appears to be commonly accepted that conventional general purpose digital time displays excel in informing the user of the present time at the moment of the readout, it is also recognized that burdensome mental calculations are required to translate that readout in the viewer's mind into grosser time contexts, e.g. the position of the precise time relative to a larger interval such as an hour or half hour, or how much time remains before the next hour or half hour, or how much time has passed or is to pass in relation to the occurrence of other exact times as previous or future references. Thus, conventional general purpose digital time displays suffer from the basic drawback of isolating the present time without also providing rapidly comprehendible indications of the larger time contexts which individuals ordinarily relay upon to carry out their general activities and for which analog time displays are far superior because of the graphic overall picture of gross time presented by their hand positions relative to the dial face markings. These and like problems in the use of conventional digital time displays haye been described specifically, for example, in a survey reported in the November 1976 issue of Consumer Reports (Vol. 41, No. 11), a well known consumer products evaluation journal.

SUMMARY OF THE INVENTION

Balanced digital time display systems and methods for minimizing or avoiding the above problems associated with conventional digital time displays are described in co-pending application Ser. No. 861,115, filed Dec. 16, 1977. The disclosure of that application is incorporated herein by reference as background to the present invention, which provides an improvement in the previously-described systems and methods.

More particularly, the present invention is based upon quadri-balanced digital time display systems and methods which provide an additional advantage of distinguishing the current quarter hour from amongst the four quarters of an hour and thereby making evident the relationship between any exact present time readout and the current quarter hour, such being denoted by the designation "quadri-balanced".

This advantage is achieved by the use of digital time displays in which, during the first quarter of a present hour, minute digits are positioned in a relatively upper area trailing hour digits and operated to count increasing digit values of minutes, e.g. from 01 to 15. Next, during the second quarter hour, minute digits are positioned in a relatively lower area trailing the hour digits and operated to count further increasing digit values of minutes, e.g. from 16 to 30. Thereafter, during the third quarter hour, the hour digits are increased to the value of the next hour, and minute digits are positioned in a relatively lower area leading the hour digits and operated to count decreasing digit values of minutes, e.g. from 29 to 15. Finally, during the fourth quarter hour, minute digits are positioned in a relatively upper area leading the displayed next hour digits and operated to count further decreasing values of minutes, e.g. from 14 to 00. This cycle is repeated for each successive hour.

The foregoing results in the sequencing of four sets of minute digits in a clockwise rotation around hour digits, synchronized with the progress of time from start to end of each hour. Since these sets are geometrically distinguished from each other and in direct correspondence with the quarter-hour positions traversed by a conventional analog minute hand during its hour-long 360° rotation, the viewer is given, at a glance, an immdiately comprehendible picture of the present quarter hour, without having to read the actual values of the displayed hour and minute digits. This, in turn, makes evident the relationship between any exact time readout represented by those actual values and the intervals of the present quarter hour and the present half hour. The quadri-balanced systems and methods of this invention thus enable digital time displays, without loss of digital precision, to simulate the graphics of progressively larger current time intervals, in a manner analogous to the operation of often preferred analog time displays.

If desired, a seconds display similar to the one disclosed in the previous patent application may be incorporated in the quadri-balanced displays of the present invention. In that case, display elements for counting seconds will be included, preferably below centrally-positioned hour digits, and operated to count seconds up from 01 to 30 and then down from 29 to 00, this count being synchronized with the interval of each minute. Such a display will inform the user of the position and significance of the exact present time relative to gradually larger time intervals of importance in general purpose time keeping, i.e. from a fractional minute to the present minute, to the present quarter hour, to the present half hour, to the present hour. As a result of the foregoing features, and the other advantages described in the previous patent application, the quadri-balanced digital displays of this invention integrate the precision of digital time keeping with the facility of analog time keeping in a manner which overcomes many of the objections heretofore expressed against conventional digital time displays.

Other features and advantages of the invention will be evident from the subsequent detailed description, taken in connection with the drawings.

DESCRIPTION OF THE PREFERRED EMBODIMENT

Figure 1:
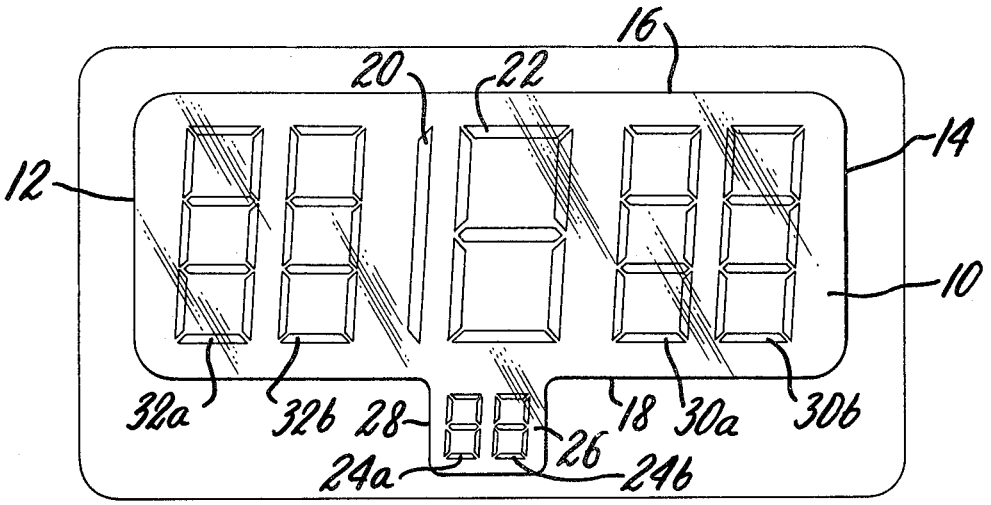
FIG. 1 is a front view of energizable digital display elements arranged for quadri-balanced time displays in accordance with a preferred embodiment of the invention.

Referring to FIG. 1, illustrated there is a horizontally oriented display background 10 outlined by side perimeters 12 and 14, and upper and lower perimeters 16 and 18. At the center of background 10 is an energizable vertical line element 20 and, to its right, a 7-segment array of energizable elements 22. The elements 20 and 22 consist of light emitting diode or liquid crystal display elements which may be energized to display hour digit values ranging from 1 to 12.

Below the elements 20 and 22 is another pair of 7-segment arrays of energizable display elements 24*a* and *b*, of substantially smaller size than elements 20 and 22 and positioned in a smaller background 26 defined by the U-shaped extension 28 projecting downwardly from lower perimeter 18. The elements 24*a* and *b* may be energized to display digits counting seconds from 01 to a peak value of 30 and, thereafter, from 29 to 00, as will be explained further below.

To the right of elements 20 and 22 is a pair of 10-segment ladder-like arrays of energizable elements 30*a* and *b*. Each arrray is composed of four equi-spaced horizontal line elemets (analogous to ladder steps) and three pairs of equi-spaced interspersed vertical line elements (analogous to ladder side rails). This arrangement enables the use of the uppermost seven elements (three horizontals and two pairs of interspersed verticals) to display digits ranging from 0 to 5 in a relatively upper area to the right of elements 30 and 22, i.e. an upper part of the space or readout position trailing those elements. Conversely, energization of the lowermost seven elements (again three horizontals and two pairs of interspersed verticals) will enable display of digits from 16 to 30 shifted in position to a relatively lower area to the right of the elements 20 and 22, i.e. a lower part of the space or readout position trailing those elements. The central two horizontal and two vertical elements of each ladder array thus are shared during the total count from 01 to 30.

Since the overall height of the ladder arrays 30*a* and *b* is the same as that of elements 20 and 22, and since the horizontal elements of the arrays 30*a* and *b* are equally spaced, it will be evident that the above described digits positioned in relatively upper or lower areas will, in either case, be about $\frac{2}{3}$ the size of those displayed by elements 20 and 22, but also considerably larger than those displayed by elements 24*a* and *b*. Also, when the ladder arrays 30*a* and *b* display digits in the relatively upper area to the right of elements 20 and 22, the remaining $\frac{1}{3}$ area below them will be vacant, whereas the converse will occur when the digits are in the relatively lower area, leaving the remaining $\frac{1}{3}$ area above empty.

Another pair of ladder-like arrays of display elements 32*a* and *b*, identical in size and general function to 30*a* and *b*, is positioned to the left of elements 20 and 22. Elements 32*a* and *b* may be energized to display digits from 29 to 15 in a relatively lower area, i.e. a lower part of the space or readout position leading elements 20 and 22, followed by a shift to digits ranging from 14 to 00 positioned in a relatively upper area, i.e. an upper part of the space or readout position leading elements 20 and 22, with $\frac{1}{3}$ upper and lower areas respectively unoccupied, in analogous manner to the operation of arrays 30*a* and *b*.

Figure 2:
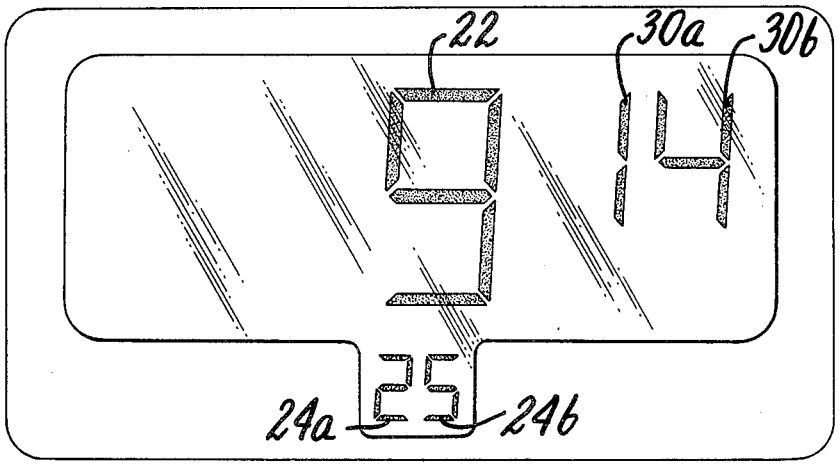
FIG. 2 is a view similar to FIG. 1 showing a representative first quarter hour display.

Referring now to FIG. 2, illustrated there is the arrangement of FIG. 1 energized in a manner such that (A) the elements 22 display the digit "9", (B) the elements 30*a* and *b* display the digits "14", and (C) the elements 24*a* and *b* display the digits "25". This display informs the viewer that the exact present time is fourteen minutes past the ninth hour (A.M. or P.M.) and, more precisely, that twenty-five seconds of that fourteenth minuted have elapsed or remain (depending on whether the peak seconds value of "30" is approaching or has passed).

Since the minute digits are in a relatively upper readout position trailing the hour digit, the viewer is also informed that the present time is within the first quarter hour of the present hour, without having to read the values of the digits. That the intermediate-sized minute digits are trailing the larger centrally-positioned hour digit in a relatively upper area comprising the uppermost $\frac{2}{3}$ of the height of the hour digit (with the remaining $\frac{1}{3}$ of the trailing space empty) is sufficient to make immediately known the existence of the first quarter of the present hour, independently of digit values. The geometry of the display thus simulates that of a conventional analog minute hand positioned in the first quarter of the complete circle it traverses during the course of an hour.

Figure 3:
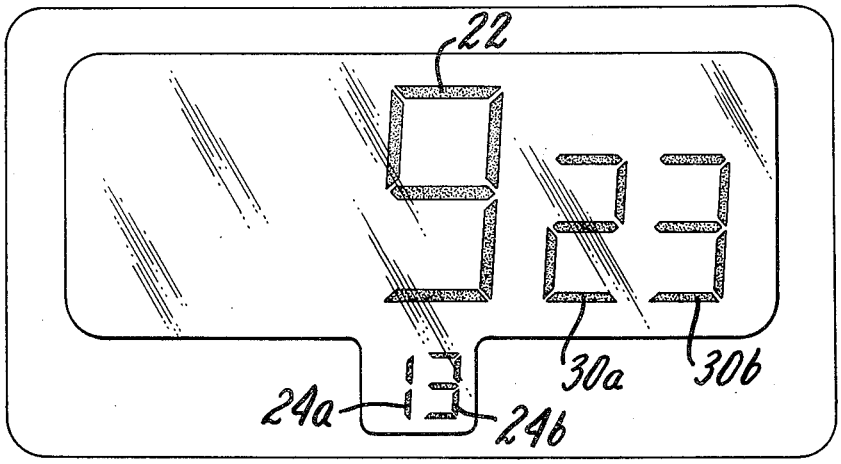
FIG. 3 is a view similar to FIG. 1 showing a representative second quarter hour display.

Referring now to FIG. 3, illustrated there is the arrangement of FIG. 1 energized in a manner such that (A) the elements 22 display the digit "9", (B) the elements 30*a* and *b* display the digits "23", and (C) the elements 24*a* and *b* display the digits "13".

This display informs the viewer that the exact present time is twenty-three minutes past the ninth hour and that thirteen seconds of that twenty-third minute have elapsed or remain, depending upon the current progress of the seconds count up to and down from the peak value of thirty. The geometry of the display also makes immediately evident the fact that the present time is within the second quarter of the current hour, independently of digit values, because the minute digits have shifted in position to the lowermost ⅔ of the space trailing the hour digit, leaving the remaining ⅓ space above empty. The FIG. 3 display thus simulates the positioning of a conventional analog minute hand in the consecutive second quarter of the complete circle it traverses during the course of an hour. This means that at a glance and without having to read the digit values, the viewer is informed by such geometry that the present time is within the second quarter of the current hour.

Figure 4:
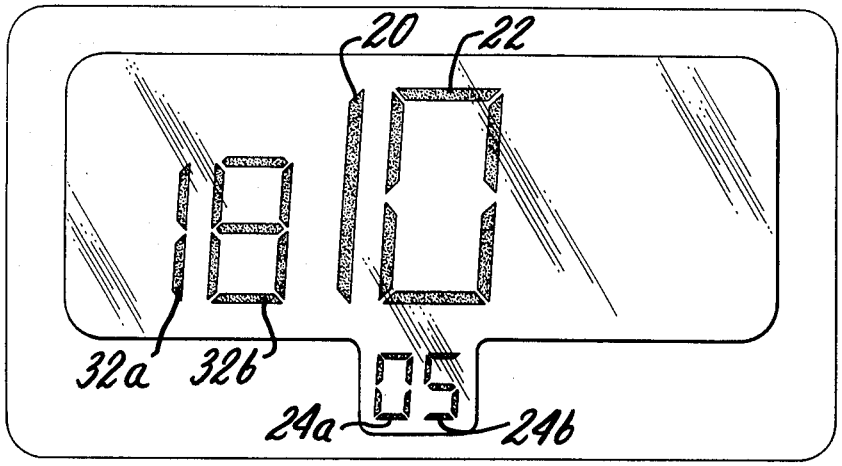
FIG. 4 is a view similar to FIG. 1 showing a representative third quarter hour display.

Referring now to FIG. 4, illustrated there is the arrangement of FIG. 1 energized in a manner such that (A) the elements 20 and 22 display the digits "10", (B) the elements 32*a* and *b* display the digits "18", and the elements 24*a* and *b* display the digits "05".

In this display, the minute digits lead the hour digits relative to the left-to-right readout direction, and the value of the hour digits has been increased to that of the approaching next hour. Therefore, the display informs the viewer that the exact present time is the eighteenth minute before the oncoming tenth hour and that five seconds of that minute have elapsed or remain, depending again on the progress of the up-down count of seconds relative to the peak value of thirty.

The switching of the minute digits to a position leading the hour digits in FIG. 4, and the resultant emptying of the entire trailing space occupied by the now de-energized elements 30*a* and *b*, immediately signifies, independent of the digit values, that the first half of the current hour has elapsed and less than the second half remains. This simulates a conventional analog minute hand crossing from right to left sides of the 12-o-clock-6-o-clock axis dividing into equal halves the complete circle it traverses during the course of an hour. This effect is reinforced by the increase of the value of the hour digits to that of the next hour, which simulates the positioning of a conventional analog hour hand closer, after the half hour point, to the dial mark which represents the next approaching hour. Moreover, the relatively lower position of the minute digits, comprising the lowermost ⅔ part of the space adjacent to and leading the hour digits, signifies that the present time is within the third quarter of the current hour, again simulating the positioning of a conventional analog minute hand in the consecutive third quarter of the complete circle it traverses during the course of an hour.

Figure 5:
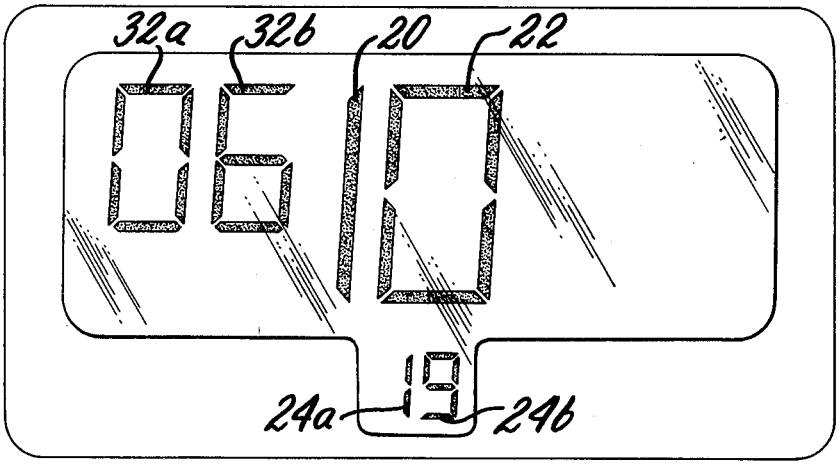
FIG. 5 is a view similar to FIG. 1 showing a representative fourth quarter display.

Referring now to FIG. 5, illustrated there is the arrangement of FIG. 1 energized in a manner such that (A) the elements 20 and 22 display the digits "10", (B) the elements 32*a* and *b* display the digits "06", and (C) the elements 24*a* and *b* display the digits "19".

This display informs the viewer that the exact present time is the sixth minute before the oncoming tenth hour and that nineteen seconds of that minute have elapsed or remain, depending upon whether the peak seconds count of thirty is still to be, or has been, seen. Also, the minute digits have shifted to a relatively upper area comprising the uppermost ⅔ part of the space adjacent to and leading the hour digits, leaving the remaining ⅓ part below empty. This signifies, at a glance and independent of the digit values, that the present time is within the last quarter of the current hour, again simulating the positioning of a conventional analog minute hand in the consecutive fourth quarter of the complete circle it traverses during the course of an hour.

Figure 6:
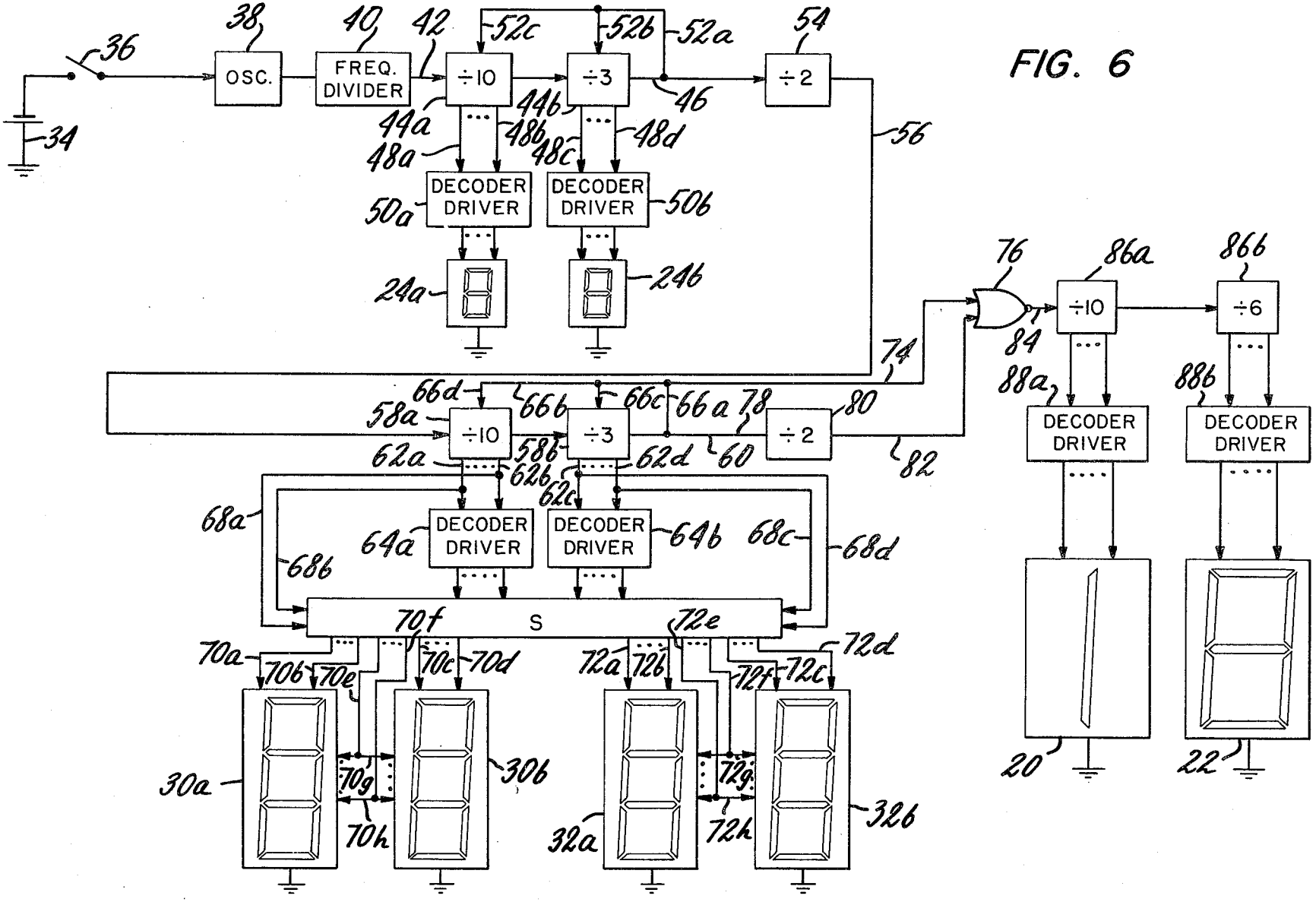
FIG. 6 is a block diagram of an electronic circuit suitable for energizing the display elements of FIG. 1 in accordance with FIGS. 2 to 5.

Referring to FIG. 6, illustrated there is a circuit for energizing the display elements shown in FIG. 1 in accordance with the representative modes shown in FIGS. 2 through 5. The circuit is powered by an energy source such as a battery 34 connected to switch 36. When closed, switch 36 connects the power from source 34 to a high frequency solid state oscillator 38, which oscillates at a high enough frequency to provide an accurate base time signal, e.g. $2^{15}$, or 32,768, Hz. The oscillator output is fed to a multi-stage frequency divider 40 which successively divides the oscillator frequency down to 1 Hz (i.e. one cycle per second), such pulses appearing as an output on line 42.

This 1 Hz signal is transmitted to a solid state up-down counter having internal stage 44*a* operating as modulo 10 and stage 44*b* operating as modulo 3, the combined stages dividing the 1 Hz signal as a scale of thirty divider to produce a pulse every thirty seconds as an output on line 46. As the counter 44 counts the 1 Hz pulses inputted on line 42, each count is outputted by the counter stages as a binary code or binary coded decimal signal over lines 48*a, b, c,* and *d* to decoder-driver units, which translate the binary signals into discriminating signal patterns for selectively energizing the 7-segment display elements 24*a* and *b* to display digits corresponding to an up count from 01 to 30.

At that point (and after each successive thirty-seconds interval), an output pulse appears on line 46, which is returned by lines 52*a, b* and *c* to counter stages 44*a* and 44*b* to reverse the count direction, whereby the next thirty pulses inputted by line 42 will be counted down. As a result, the same binary code or binary coded decimal signals which were generated by the counter 44 during the up count again will be outputted to the decoder-drivers 50, this time in an opposite progression, whereby the 7-segment arrays of display elements 24 are selectively energized by the decoder-drivers to display the corresponding digits from 29 to 00. At that time, another pulse appears on line 46 which is transmitted back over lines 52 again to reverse the count direction, whereby the next thirty pulses will be counted up to begin a repetition of the previous cycle. Thus, it can be seen that the display elements 24*a* and *b* will be driven to count up for thirty seconds and then down for thirty seconds, and corresponding balanced progressions of second digit values will be displayed throughout the time that the circuit is energized.

The pulses appearing every thirty seconds on line 46 are inputted to a frequency divider 54, which divides the frequency in half, and thereby outputs a pulse on line 56 every sixty seconds, or once a minute. These pulses are transmitted to another up-down counter 58, similar to counter 44, and having a modulo 10 stage 58*a* and a modulo 3 stage 58*b*, which together divide the one-per-minute frequency of the input pulses as a scale of thirty divider to produce an output pulse on line 60 once every thirty minutes, or every half hour.

The input pulses transmitted by line 56 are counted and outputted from the counter stages 58*a* and *b* by lines 62*a, b, c* and *d* to decoder-drivers 64*a* and *b*, and the once-per-half-hour output pulses appearing on line 60 are returned to the counter over lines 66*a, b, c* and *d* to control the count direction every thirty minutes, in the same manner as described above for the counter stages 44 and decoder-drivers 50 associated with the seconds display 24, the essential difference being the lower frequency at which the operation is carried out for the minutes display. Thus, the counter output binary signals are translated by the decoder-drivers 64 into discriminating signal patterns for selectively energizing pairs of 7-segment arrays of display elements to display digits counting minutes up from 01 to 30 and then down from 29 to 00, such signal patterns being outputted by lines 68*a, b, c* and *d* into a switching network S. Also, the minutes count is synchronized with the seconds count being displayed by the elements 24, whereby the balanced up-down progression of the digits counting seconds between values 00 and 30 coincides with the period of each minute being displayed by elements 24.

The output of counter stages 58*a* and *b* is transmitted by lines 68*a, b, c* and *d* to the switching network S, in parallel with the decoder-drivers 64*a* and *b*, to control the routing of the decoder-driver outputs to the pairs of 10-segment ladder arrays 30*a* and *b*, and 32*a* and *b*. Lines 70*a* and *b* represent connections between network S and only the uppermost three segments (two verticals and one horizontal) and the lowermost three segments (also two verticals and one horizontal) of array 30*a*. Similarly, lines 70*c* and *d* represent connections between network S and only the uppermost three and lowermost three segments of array 30*b*.

Lines 70*e* and *f* represent connections between network S and the central four segments of both arrays 30*a* and *b* (two horizontals and two verticals each), via parallel connecting lines 70*g* and *h*. Therefore, by signal transmission over the appropriate lines, the uppermost three segments and the central four segments of the array pair 30*a* and *b* can be energized together as a pair of 7-segment elements displaying minute digits in the relatively upper trailing position shown in FIG. 2. Switching network S is programmed to route the outputs of the decoder-drivers to these uppermost segment pairs during the count of the first fifteen minutes, this quarter-hour interval being provided to the network S by lines 68*a, b, c* and *d*.

Thereafter, network S is programmed to connect, for the next fifteen minutes demarcated by the inputs from line 68*a, b, c* and *d*, the outputs of the decoder-drivers 64 to those of the lines 70*a, b, c* and *d* leading to the lowermost three segments and the central four segments of arrays 30*a* and *b*. The resulting pairs of energized 7-segment arrays display digits from 16 to 30 shifted to the relatively lower position of FIG. 3, the uppermost three segments of both arrays being simultaneously de-energized to develop the empty space above such minute digits in the uppermost ⅓ part of the space trailing the hour digits.

The lines 72 provide the same connections and functions for the pair of 10-segment ladder arrays 32*a* and *b*. Lines 72*a, b, c* and *d* represent dedicated connections leading from switching network S only to the uppermost and lowermost three segments of array 32*a*, and the uppermost and lowermost three segments of array 32*b*. Lines 72*e, f, g* and *h* connect the switching network S in parallel to the central four segments of both arrays 32*a* and *b*.

During the third set of fifteen minutes counted by counter 58, switching network S is programmed to connect the outputs of the decoder-drivers 64 to the lowermost three and central four segments of both arrays 32*a* and *b*, whereby the resulting pair of 7-segment arrays displays the minute digits 29 to 15 in the relatively lower position leading the hour digits in FIG. 4. This also empties the entire trailing space to the right of the hour digits display 20 and 22, by de-energization of the array pair 30*a* and *b*.

During the final or last quarter hour set of fifteen minutes counted by counter 58, switching network S routes the output of the decoder-drivers 64 to the uppermost three and central four segments of the arrays 32*a* and *b*. The resulting pair of 7-segment arrays displays the minute digits 14 to 00 in the relatively upper position leading the hour digits shown in FIG. 5, with emptying of the remaining ⅓ space below. The above sequencing of minute digits repeats in each successive hour.

The pulse appearing every thirty minutes on line 60 is transmitted by lines 66*a* and 74 to a NAND gate 76, and by line 78 to a frequency divider 80. The latter divides the frequency of the input pulses by two to output a pulse once every hour, which also is transmitted by line 82 to NAND gate 76. Gate 76 produces an output pulse on line 84 whenever the once-per-thirty-minute pulse alone is inputted by line 74, but does not conduct when both that pulse and the pulse appearing once per hour on 82 are simultaneously inputted. As a result gate 76 is synchronized with the minute and second digits being displayed by the arrays 30, 32 and 24 to produce an output pulse on line 84 once every hour on the half hour, in coincidence with the peak value of 30 reached by the minutes display.

The output pulse from gate 76 is transmitted to a two stage counter 86*a* and *b* to increase the value of the counter output by one, this being repeated over a 12-hour range of hour digit values with each successive pulse appearing on line 76 at each hour on the half hour. The counter output is transmitted as a binary code or binary coded decimal signal to the decoder-drivers 88*a* and *b* which translate this input as discriminating signal patterns for selectively energizing the display elements 20 and 22 incrementally over the above-described 12-hour cycle.

The circuit illustrated in FIG. 6 utilizes a switching network S interposed between the decoder-drivers and digit display elements, which is feasible with light emitting diode or line powered displays. With liquid crystal displays, however, to avoid problems of incomplete de-energization of the display elements due to the high impedances involved, it will be understood that the network S or the switching functions thereof will be transposed either to between the decoders and drivers or before the decoder-driver combinations. Also, the circuit will be associated in actual use with switches and circuit means for effecting gross changes in the displayed digit values in order to permit setting of the displays or resetting, e.g. when traveling across different time zones, or moving the hour ahead or back at different seasons. Since the means for achieving such setting adjustments are well known and not part of this invention, they have not been specifically described here. The FIG. 6 circuit also may be associated with conventional circuits and means for presenting simultaneous or alternative calendar displays of the day of the week and date of the month, which circuits and means are well known, not part of this invention and, therefore, not specifically described here.

The invention has now been described in terms of its fundamental operating principles and a preferred embodiment thereof. In addition to all of the advantages described in the previously-identified patent application, the present invention provides the further advantage of visually distinguishing the four quarters of each hour, independently of the values of displayed digits and in an unambiguous manner. The graduated sizes of the displayed digits, with hours largest, minutes intermediate and seconds (when used) smallest, which are in direct correspondence with the magnitudes of the time intervals represented by each, avoid confusion or ambiguity. The clockwise sequencing of the minute digits in four sets about the centrally positioned hour digits, combined with the balanced minute digit value progressions increasing and decreasing relative to a peak value of thirty, and the hour digit value advancing at each half hour on the hour, provide an overall effect which is reminiscent of the shifting geometry of analog time displays over the course of an hour. As a result, the quadri-balanced digital time displays of the present invention not only inform the viewer of the exact present time via digit values but also of the larger time intervals of the current quarter hour and half hour via digit sizes, formats and position changes without dependence upon digit values. This provides the viewer with a dual advantage of the precision of digital time values and the facility of analog time graphics, thus achieving in one system the best capabilities of separate conventional digital and analog time keeping without the disadvantages of either.

It will be evident to those skilled in the art that the invention may be implemented with various modifications without departing from its fundamental principles. For example, the seconds display included in the illustrative embodiment can be eliminated where that degree of precision is not required or desired, and the remaining hour and minute displays will provide all of the other advantages and benefits previously described.

To reduce the number of elements in the total display, a pair of ladder arrays like 30 or 32 can be positioned at the center of the display, and two sets of hour elements like 20 and 22 can be arranged to flank the opposite sides thereof, with appropriate switching in both the minutes and hour stages of the FIG. 6 circuit, to establish with fewer elements the described trailing-leading positions of hours and minutes, and the relatively upper and lower positions of minutes during successive quarter hours. This alternative, by substituting one set of elements like 20 and 22 for one pair of ladder arrays, reduces the total number of elements by twelve (20-8). It can also enable the total horizontal extent of the display to be more compact in view of the substitution of two vertical line elements like 20 having virtually negligible thickness, for the two wider horizontal spacings of the eliminated pair of ladder arrays.

Although the illustrative embodiment has been described as displaying the 00 minute digit value marking the start of an hour in the upper leading readout position shown in FIG. 5, if desired the smallest minute digit value in that position can be terminated at 01, and the 00 value transferred for display in the upper trailing position of FIG. 2 in order to begin each hour in a more familiar manner to the viewer.

Similarly, the viewer can be given the option to switch the display during the second half of any hour in a manner such as to return the value of the displayed hour digits to that of the current hour (instead of the next approaching hour) and to convert the value of the displayed minute digits to total elapsed minutes of the current hour (instead of minutes remaining to the next hour). In other words, the displays illustrated in FIGS. 4 and 5 may be switched to show "9" as the hour digit and "42" and "54" as the respective minute digits. This may be considered desirable when checking or resetting the displays in comparison to conventional announcements of accurate time signals, e.g. by telephone or radio, or in other situations encountered in general day-to-day activities.

In the illustrative embodiment, the tops and bottoms of the two pairs of 10-segment ladder-like-arrays are level with the tops and bottoms of the hour display elements 20 and 22 for streamlining and compactness. However, other proportions of minute digits relative to hour digits can be implemented. For example, the total vertical height of the ladder arrays can be expanded with retention of the equal spacing between the horizontal elements, whereby in use the relatively upper and lower positioned minute digits will extend beyond the tops and bottoms of the hour digits to enhance the impression of quarter hour time intervals progressing clockwise around the hour digits. Alternatively, the ladder arrays may be substituted on each side of the hour display elements with two separate pairs of conventional 7-segment display arrays aligned vertically over each other. This will enable shifting the positions of the minute digits between the upper and lower halves of the trailing and leading spaces flanking the hour digits, with the other halves correspondingly empty, thereby simulating in more analogous proportions the quarter circle traverses of a conventional analog minute hand.

Also, although the illustrative embodiment has been described in specific terms of electrically energizable display elements, such as the light emitting diode or liquid crystal displays currently used in conventional digital time displays, it is evident that the invention may be implemented as well with mechanical display elements such as rotating wheels or tapes presenting incremental digit values on their surfaces for viewing through open or shuttered apertures or windows. Generally, all forms of display elements which are operable to display digits in formats, value sequences and readout positions conforming to the principles of the invention may be used to achieve the advantages and improvements which have been described.

Accordingly, it will be understood that the invention is not limited to the illustrative preferred embodiment but encompasses the subject matter delineated by the appended claims and all equivalents thereof.

The following is claimed:

1. A quadri-balanced digital time display system which comprises:

(a) hour elements operable for displaying hour digit values, (b) minute elements operable for displaying minute digit values, (c) means for operating the hour elements to display the digit value of an hour, (d) means for operating the minute elements during a first portion of the hour to display minute digit values in a readout position which trails the displayed hour and which comprises a relatively upper part of that trailing position, (e) means for operating the minute elements during a second portion of the hour to display minute digit values in a readout position which trails the displayed hour and which comprises a relatively lower part of that trailing position, (f) means for operating the minute elements during a third portion of the hour in a readout position which leads the displayed hour and which comprises a relatively lower part of that leading position, and (g) means for operating the minute elements during a fourth portion of the hour in a readout position which leads the displayed hour and which comprises a relatively upper part of that leading position.

2. A system as in claim 1 which further includes second elements operable for displaying second digit values, means for operating the second elements to display increasing digit values of seconds during a portion of a minute, and means for operating the second elements to display decreasing digit values of seconds during a subsequent portion of the same minute.

3. A system as in claim 2 in which the overall size of the displayed hour digits is largest, the overall size of the displayed second digits is smallest and the overall size of the displayed minute digits is intermediate those of the displayed hour and second digits.

4. A quadri-balanced digital time display system which comprises:

(a) hour elements operable for displaying hour digit values, (b) minute elements operable for displaying minute digit values, (c) means for operating the hour elements to display the digit value of a present hour during the first half thereof and to display the digit value of the next hour during the second half of the present hour, (d) means for operating the minute elements during the first quarter of the present hour to display increasing digit values of minutes in a readout position which trails the displayed present hour and which comprises a relatively upper part of that position, (e) means for operating the minute elements during the second quarter of the present hour to display further increasing digit values of minutes in a readout position which trails the displayed present hour and which comprises a relatively lower part of that trailing position, (f) means for operating the minute elements during the third quarter of the present hour to display decreasing digit values of minutes in a readout position which leads the displayed next hour and which comprises a relatively lower part of that leading position, and (g) means for operating the minute elements during the fourth quarter of the present hour to display further decreasing digit values of minutes in a readout position which leads the displayed next hour and which comprises a relatively upper part of that leading position.

5. A system as in claim 4 which further includes second elements operable for displaying second digit values, means for operating the second elements to display increasing digit values of seconds during the first half of a minute, and means for operating the second elements to display decreasing digit values of seconds during the second half of the same minute.

6. A system as in claim 5 in which the overall size of the displayed hour digits is largest, the overall size of the displayed second digits is smallest and the overall size of the displayed minute digits is intermediate those of the displayed hour and second digits.

7. A system as in 6 in which the minute elements are operated to display:

(i) during the first quarter hour, digit values from 01 to 15, (ii) during the second quarter hour, digit values from 16 to 30, (iii) during the third quarter hour, digit values from 29 to 15, and (iv) during the fourth quarter hour, digit values from 14 to 00.

8. A quadri-balanced digital time display system which comprises:

(a) hour elements operable for displaying hour digit values ranging between 1 and 12, (b) minute elements operable for displaying minute digit values ranging between 00 and 30, (c) means for operating the hour elements to display the digit value of a present hour during the first half thereof and to display the digit value of the next hour during the second half of the present hour, (d) means for operating the minute elements during the first quarter of the present hour to display minute digit values from 01 to 15 in a readout position which trails the displayed present hour and which comprises a relatively upper part of that trailing position, (e) means for operating the minute elements during the second quarter of the present hour to display minute digit values from 16 to 30 in a readout position which trails the displayed present hour and which comprises a relatively lower part of that trailing position, (f) means for operating the minute elements during the third quarter of the present hour to display minute digit values from 29 to 15 in a readout position which leads the displayed next hour and which comprises a relatively lower part of that leading position, and (g) means for operating the minute elements during the fourth quarter of the present hour to display minute digit values from 14 to 00 in a readout position which leads the displayed next hour and which comprises a relatively upper part of that leading position.

9. A system as in claim 8 in which the minute digit values displayed during the first quarter hour are from 00 to 15 and during the fourth quarter hour from 14 to 1.0

10. A system as in claim 8 in which the overall size of the displayed hour digits is larger than that of the displayed minute digits.

11. A system as in claim 10 which further includes second elements operable for displaying second digit values of smaller overall size than that of the displayed minute digits, means for operating the second elements to display increasing digit values of seconds from 01 to 30 during the first half of a minute, and means for operating the second elements to display decreasing digit values of seconds from 29 to 00 during the second half of the same minute.

12. A system as in claim 8 in which the hour elements comprise a vertical line display element and a trailing 7-segment array of display elements in reference to a left-to-right readout direction, and the minute elements comprise two pairs of 10-segment ladder-like arrays of display elements, one pair being positioned on each of the leading and trailing readout sides of the hour elements, each of the 10-segment arrays further comprising four equi-spaced horizontal line elements analogous to ladder steps and three pairs of spaced interspersed vertical line elements analogous to ladder side rails, whereby the uppermost seven segments of the pairs of 10-segment ladder-like arrays may be operated to display minute digit values in relatively upper leading and trailing readout positions, and conversely the lowermost seven segments of the pairs of 10-segment ladder-like arrays may be operated to display minute digit values in relatively lower leading and trailing readout positions.

13. A system as in claim 12 in which the overall heights of the hour elements and the two pairs of 10-segment ladder-like arrays are substantially equal and the tops and bottoms thereof are substantially level with each other, whereby operation of the uppermost seven segments of the 10-segment ladder-like arrays will display minute digits substantially two-thirds the size of displayed hour digits in relatively upper readout positions comprising the uppermost two-thirds of the spaces leading and trailing the displayed hour digits with the remaining one-thirds of those spaces empty, and conversely operation of the lowermost seven segments of the 10-segment ladder-like arrays will display minute digits in relatively lower readout positions comprising the lowermost two-thirds of the spaces leading and trailing the displayed hour digits with the remaining one-thirds of those spaces empty.

14. A system as in claim 12 which further includes seconds elements operable for displaying second digit values in a readout position below the displayed hour digits, the overall size of the displayed second digits being smallest relative to the displayed hour and minute digits, means for operating the second elements to display increasing digit values of seconds from 01 to 30 during the first half of a minute and means for operating the second elements to display decreasing digit values of seconds from 29 to 00 during the second half of the same minute.

15. A system as in claim 12 in which the displayed hour digits remain in a stationary position throughout operation of the system.

16. A system for displaying digits in shifted positions having a common shared area which comprises:

(a) an array of four energizable equi-spaced horizontal line elements analogous to ladder steps, and three pairs of energizable spaced vertical line elements interspersed with the four horizontal elements analogous to ladder side rails, (b) means for energizing seven elements of the array comprising the uppermost two horizontal and two pairs of spaced vertical interspersed elements to display any of the digits from 0 to 9 in a relatively upper position, and (c) means for energizing seven elements of the array comprising the lowermost two horizontal and two pairs of vertical interspersed elements to display any of the digits from 0 to 9 in a relatively lower position.

17. A system as in claim 16 comprising a pair of the recited arrays adjacent each other, whereby double digits comprising 00 and higher may be displayed in relatively upper and lower positions by energization of the recited uppermost and lowermost seven elements in pairs.

18. A quadri-balanced digital time keeping method which comprises:

(a) displaying the digit value of an hour, (b) displaying during a first portion of the hour, minute digit values in a readout position which trails the displayed hour and which comprises a relatively upper part of that trailing position, (c) displaying during a second portion of the hour, minute digit values in a readout position which trails the displayed hour and which comprises a relatively lower part of that trailing position, (d) displaying during a third portion of the hour, minute digit values in a readout position which leads the displayed hour and which comprises a relatively lower part of that leading position; and (e) displaying during a fourth portion of the hour, minute digit values in a readout position which leads the displayed hour and which comprises a relatively upper part of that leading position.

19. A quadri-balanced digital time keeping method which comprises:

(a) displaying the digit value of an hour, (b) displaying during a first portion of the hour increasing digit values of minutes in a readout position which trails the displayed hour and which comprises a relatively upper part of that trailing position, (c) displaying during a second portion of the hour further increasing digit values of minutes in a readout position which trails the displayed hour and which comprises a relatively lower part of that trailing position, (d) displaying during a third portion of the hour decreasing digit values of minutes in a readout position which leads the displayed hour and which comprises a relatively lower part of that leading position; and (e) displaying during a fourth portion of the hour further decreasing digit values of minutes in a readout position which leads the displayed hour and which comprises a relatively upper part of that leading position.

20. A method as in claim 19 which further includes the steps of maintaining the overall size of the displayed hour digits greater than the overall size of the displayed minute digits.

21. A method as in claim 19 which further includes the steps of displaying increasing digit values of seconds during a portion of a minute, and displaying decreasing digit values of seconds during a subsequent portion of the same minute.

22. A method as in claim 21 which further includes the steps of maintaining the overall size of the hour digits largest, the overall size of the displayed second digits smallest, and the overall size of the minute digits intermediate those of the displayed hour and minute digits.

23. A quadri-balanced digital time keeping method which comprises:

(a) displaying the digit value of a present hour during the first half thereof and increasing the displayed present hour to the digit value of the next hour during the second half of the present hour, (b) displaying during the first quarter of the present hour increasing digit values of minutes in a readout position which trails the displayed present hour and which comprises a relatively upper part of that trailing position, (c) displaying during the second quarter of the present hour further increasing digit values of minutes in a readout position which trails the displayed present hour and which comprises a relatively lower part of that trailing position, (d) displaying during the third quarter of the present hour decreasing digit values of minutes in a readout position which leads the displayed next hour and which comprises a relatively lower part of that leading position, and (e) displaying during the fourth quarter of the present hour further decreasing digit values of minutes in a readout position which leads the displayed next hour and which comprises a relatively upper part of that leading position.

24. A method as in claim 23 which further includes the steps of displaying in a readout position below the hour digits increasing digit values of seconds from 01 to 30 during the first half of a minute and decreasing digit values of seconds from 29 to 00 during the second half of the same minute, and maintaining the overall size of the displayed hour digits largest, the overall size of the second digits smallest, and the overall size of the minute digits intermediate those of the displayed hour and minute digits.

25. A method as in claim 23 which further includes the steps of displaying:

(i) during the first quarter hour, minute digit values from 01 to 15, (ii) during the second quarter hour, minute digit values from 16 to 30, (iii) during the third quarter hour, minute digit values from 29 to 15, and (iv) during the fourth quarter hour, minute digit values from 14 to 00.

26. A method as in claim 23 which further includes the steps of displaying:

(i) during the first quarter hour, minute digit values from 00 to 15, and (ii) during the fourth quarter hour, minute digit values from 14 to 0.1

27. A method as in claim 23 which further includes the steps of maintaining the overall size of the displayed hour digits larger than that of the displayed minute digits.

28. A method as in claim 27 which further includes the steps of maintainig the overall size of the displayed minute digits substantially two-thirds that of the displayed hour digits, and maintaining the tops of the displayed minutes, when in the relatively upper parts of the leading and trailing positions, level with the tops of the displayed hour digits, and maintaining the bottoms of the displayed minute digits, when in the relatively lower parts of the leading and trailing positions, level with the bottoms of the displayed hour digits, whereby the respective remaining one-third of the leading and trailing spaces adjacent to the displayed hour digits will be maintained empty throughout the shifts of the displayed minute digits between the recited relatively upper and lower readout positions.

29. A quadri-balanced digital time display system which comprises:

(a) hour elements operable for displaying hour digit values, (b) minute elements operable for displaying minute digit values, (c) means for operating the hour elements to display the digit value of a present hour and thereafter to increase the displayed present hour to the digit value of the next hour before the commencement of the next hour, (d) means for operating the minute elements to display increasing digit values of minutes in a readout position which trails the displayed present hour and which comprises a relatively upper part of that trailing position, (e) means for operating the minute elements to display further increasing digit values of minutes in a readout position which trails the displayed present hour and which comprises a relatively lower part of that trailing position, (f) means for operating the minute elements to display decreasing digit values of minutes in a readout position which leads the displayed next hour and which comprises a relatively lower part of that leading position, and (g) means for operating the minute elements to display further decreasing digit values of minutes in a readout position which leads the displayed next hour and which comprises a relatively upper part of that leading position.

30. A system as in claim 29 wherein the displayed present hour is increased to the digit value of the next hour subsequent to thirty minutes after the commencement of the present hour.

31. A quadri-balanced digital timekeeping method which comprises:

(a) displaying the digit value of a present hour and thereafter increasing the displayed present hour to the digit value of the next hour before the commencement of the next hour, (b) displaying increasing digit values of minutes in a readout position which trails the displayed present hour and which comprises a relatively upper part of that trailing position, (c) displaying further increasing digit values of minutes in a readout position which trails the displayed present hour and which comprises a relatively lower part of that trailing position, (d) displaying decreasing digit values of minutes in a readout position which leads the displayed next hour and which comprises a relatively lower part of that leading position, and (e) displaying further decreasing digit values of minutes in a readout position which leads the displayed next hour and which comprises a relatively upper part of that leading position.

32. A method as in claim 31 which further includes the step of increasing the displayed present hour to the digit value of the next hour subsequent to thirty minutes after the commencement of the present hour.

* * * * *

UNITED STATES PATENT AND TRADEMARK OFFICE

CERTIFICATE OF CORRECTION

PATENT NO. : 4,271,497

DATED : June 2, 1981

INVENTOR(S) : Berj A. Terzian

It is certified that error appears in the above-identified patent and that said Letters Patent are hereby corrected as shown below:

Column 4, line 5: Change "5" to --15--.

Column 4, line 6: Change "30" to --20--.

Column 7, line 22: Change "24" to --30 and 32--.

Column 11, line 45: Insert --trailing-- before "position".

Column 12, line 56: Change "0.1" to --01--.

Column 13, line 58: Change "two horizontal" to --three horizontal--.

Column 13, line 63: Change "two horizontal" to --three horizontal--.

Column 15, line 47: change "0.1" to --01--.

UNITED STATES PATENT AND TRADEMARK OFFICE

CERTIFICATE OF CORRECTION

PATENT NO. : 4,271,497

DATED : June 2, 1981

INVENTOR(S) : Berj A. Terzian

It is certified that error appears in the above-identified patent and that said Letters Patent are hereby corrected as shown below:

Column 15, line 53: Change "maintainig" to --maintaining--.

Signed and Sealed this

*Fifteenth* Day of *September 1981*

[SEAL]

*Attest:*

GERALD J. MOSSINGHOFF

*Attesting Officer*

*Commissioner of Patents and Trademarks*